US006976457B2

(12) United States Patent
Klaric

(10) Patent No.: US 6,976,457 B2
(45) Date of Patent: Dec. 20, 2005

(54) TWO-STROKE ENGINE HAVING A MEMBRANE VALVE INTEGRATED INTO THE TRANSFER CHANNEL

(75) Inventor: Igor Klaric, Korb (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 44 days.

(21) Appl. No.: 10/693,488

(22) Filed: Oct. 27, 2003

(65) Prior Publication Data

US 2005/0045123 A1 Mar. 3, 2005

Related U.S. Application Data

(63) Continuation-in-part of application No. 10/125,601, filed on Apr. 19, 2002, now Pat. No. 6,644,251.

(30) Foreign Application Priority Data

Apr. 20, 2001 (DE) ..... 101 19 282

(51) Int. Cl.[7] ..... F02B 33/04

(52) U.S. Cl. ..... 123/73 A; 123/73 PP; 123/65 V

(58) Field of Search ..... 123/73 R, 73 A, 123/73 PP, 65 V

(56) References Cited

U.S. PATENT DOCUMENTS 5,870,981 A * 2/1999 Knaus et al. ..... 123/65 A
6,216,650 B1 4/2001 Noguchi
6,257,181 B1 7/2001 Rosskamp et al.
6,267,088 B1 7/2001 Rosskamp et al.
6,401,672 B2 6/2002 Raffenberg et al.
6,415,750 B2 7/2002 Rosskamp et al.
6,644,251 B2 * 11/2003 Klaric ..... 123/73 A
2002/0026912 A1 * 3/2002 Kramer et al. ..... 123/73 A
2002/0073943 A1 * 6/2002 Geyer et al. ..... 123/73 B
2002/0152973 A1 * 10/2002 Klaric ..... 123/73 A
2003/0200941 A1 * 10/2003 Schlossarczyk et al. . 123/73 PP
2005/0045123 A1 * 3/2005 Klaric ..... 123/73 A
2005/0051118 A1 * 3/2005 Hoche et al. ..... 123/73 A

* cited by examiner

*Primary Examiner*—John T. Kwon
(74) *Attorney, Agent, or Firm*—Walter Ottesen

(57) ABSTRACT

A mixture lubricated two-stroke engine includes a cylinder (4) having a cylinder head (3) and a cylinder bore (5) open to the crankcase (6). A piston (7) is displaceably arranged in the cylinder bore (5). The piston (7) and the cylinder (4) conjointly delimit a combustion chamber (8). A mixture is led into the crankcase (6) via a mixture inlet (12). The crankcase (6) is flow connected to the combustion chamber (8) via transfer channels (14, 15). The transfer channels (14, 15) are open at their ends (16) toward the crankcase (6) and are connected to bypass channels (18, 19) between the ends (16) of the transfer channels facing toward the crankcase and their ends (17) facing toward the combustion chamber. The bypass channels (18, 19) supply air and open via a membrane valve (20) into the transfer channels. The membrane (21) of the membrane valve (20) is held on a wall part of the transfer channel (14, 15). For a simple configuration, the membrane (21) is positioned in the transfer channel (14, 15) axially through the end (16) of the transfer channel (14, 15) facing toward the crankcase and is fixedly mounted on the cylinder (4) in the region of the end (16) facing toward the crankcase.

13 Claims, 7 Drawing Sheets

TWO-STROKE ENGINE HAVING A MEMBRANE VALVE INTEGRATED INTO THE TRANSFER CHANNEL

RELATED APPLICATION

This application is a continuation-in-part application of U.S. patent application Ser. No. 10/125,601, filed Apr. 19, 2002, (now U.S. Pat. No. 6,644,251), and claims priority of German patent application 101 19 282.7, filed Apr. 20, 2001.

FIELD OF THE INVENTION

The invention relates to a two-stroke engine including a mixture lubricated two-stroke engine for a portable handheld work apparatus, such as a motor-driven chain saw, cutoff machine, blower apparatus, brushcutter or the like.

BACKGROUND OF THE INVENTION

A two-stroke engine of the above kind is disclosed in U.S. Pat. No. 6,216,650. The bypass channel, which supplies clean air, opens via a membrane valve into the transfer channel which is configured as a radially open channel. The radial opening of the transfer channel is closed by a valve housing which carries the membrane valve and which is to be mounted on the cylinder. This requires a significant manufacturing and assembly effort because the valve plate is to be mounted close to the transfer channel.

SUMMARY OF THE INVENTION

It is an object of the invention to provide a two-stroke engine which is so improved that a reliable assembly of a membrane valve is provided while avoiding additional seal surfaces.

The two-stroke engine of the invention includes a two-stroke engine in a portable handheld work apparatus. The two-stroke engine includes: a crankcase; a cylinder connected to the crankcase; the cylinder having a cylinder wall defining a cylinder bore open to the crankcase; a piston displaceably mounted in the cylinder bore and the piston and the cylinder conjointly defining a combustion chamber; a crankshaft rotatably mounted in the crankcase; the piston being operatively connected to the crankshaft for driving the crankshaft; a mixture inlet in the crankcase; a transfer channel for flow connecting the crankcase to the combustion chamber and the transfer channel having a first end open to the crankcase and a second end communicating with the combustion chamber; a bypass channel for conducting an essentially fuel-free gas; the bypass channel having an opening into the transfer channel at a location between the first and second ends thereof; the transfer channel being configured as a closed channel over the length thereof in the cylinder wall; a membrane valve assembly including a membrane axially inserted into the transfer channel through the first end thereof; the membrane having an attachment section and projecting in the transfer channel up to in front of the opening; the membrane being movable between a closed position wherein the opening is closed and an open position wherein the fuel-free gas can flow through the opening and into the transfer channel; the membrane valve assembly further including a membrane carrier for supporting the membrane in the open position thereof; and, the membrane being fixedly clamped at the attachment position thereof between the membrane carrier and the cylinder at the foot region thereof.

According to the invention, the transfer channel is configured as an essentially closed channel over its length in the cylinder wall so that a tight channel guidance is provided without additional sealing measures. The membrane valve is to be mounted at the opening of the bypass valve into the transfer channel and is pushed axially into the transfer channel via the open end thereof facing the crankcase and is fixed on the cylinder in the region of the end facing toward the crankcase. The membrane projects up to in front of the opening of the bypass channel and opens and closes the opening in the manner of a check valve. The open end, which is at the crankcase side, defines the assembly opening of the membrane valve. The otherwise necessary additional sealing measures are unnecessary because of this arrangement of the membrane valve.

A two-stroke engine configured in this manner can be operated as a so-called advanced-storage engine or a stratified charge engine, depending upon how the bypass channels, which supply essentially fuel-free gas or air, are switched or controlled.

According to the invention, the membrane of the membrane valve is supported by an essentially stiff membrane carrier which holds the membrane in the open position. The membrane carrier includes a breakthrough, which is arranged at the elevation of the opening, so that the flow in the transfer channel is not hindered by the membrane carrier. The membrane carrier can be fixed in the transfer channel by an attaching screw engaging through the cylinder wall from the outside. The attaching screw is advantageously screwed into the membrane carrier.

The sealing seat for the membrane of the membrane valve is formed in the transfer channel. It is advantageous to configure this sealing seat on an insert part, which is manufactured separately from the cylinder and is mounted through the crankcase-side end of the transfer channel. The insert part is advantageously configured as a plate and is advantageously fixed in the cylinder by attachment means engaging in the cylinder from the outside. The insert part lies approximately seal tight on the inner wall of the transfer channel. The plate-shaped insert part extends over the opening of the bypass channel in the longitudinal direction of the transfer channel. A flow opening is provided in the insert part at the elevation of the opening of the bypass channel into the transfer channel and this flow opening connects the bypass channel to the transfer channel. The plate-shaped insert part engages with one end in an assembly slot provided in the cylinder and is fixed therein by attachment means introduced into the cylinder radially from the outside.

In order to ensure a precisely functioning reliable assembly of the membrane valve even by an inexperienced assembler or without sight control, projections are provided on the membrane carrier which engage in assigned openings of the cylinder wall. A first projection can be configured as a stop against rotation and a second projection can be configured as an assembly aid. The attachment screw advantageously engages in the projection forming the assembly aid. For this purpose, the projection, which defines the assembly aid, is configured as a cylinder bushing which lies with an approximate fit in a through bore for the attachment screw. The attachment screw is then screwed into the assembly projection of the membrane carrier and supports itself with its head against an outer annular shoulder of the cylinder wall. In this way, large attachment forces can be developed which ensure a reliable fixing of the membrane valve in the transfer channel.

Advantageously, the projection, which is provided as an assembly aid, can also be used to thread on the insert part. The insert part can, together with the membrane carrier and the membrane, be configured as a preassemblable component. The membrane is preferably held to be clamped between the parts.

In an advantageous embodiment of the invention, the bypass channel is connected via a connecting stub to the transfer channel and the connecting stub is configured as one part with the cylinder.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
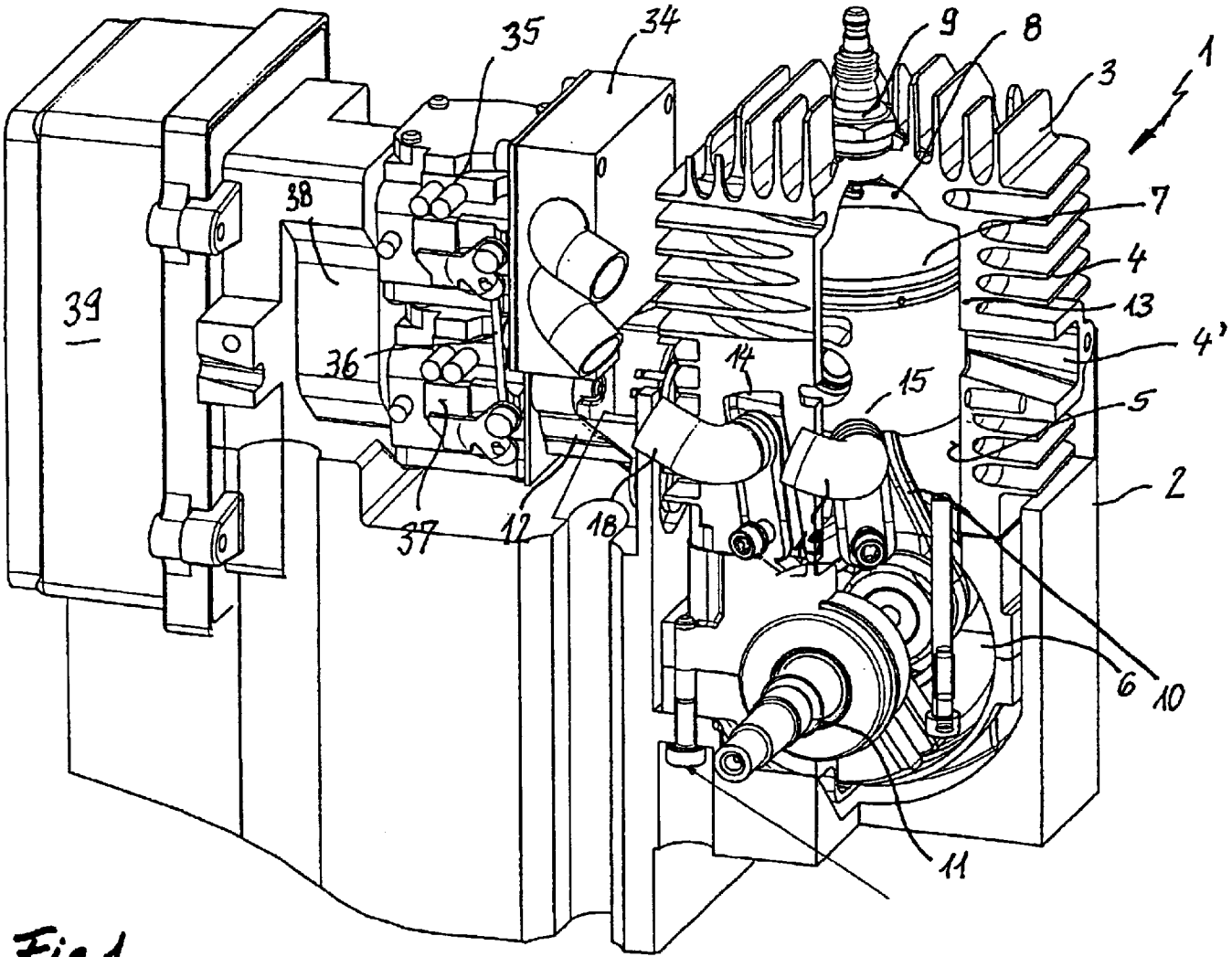
FIG. 1 is a schematic of an internal combustion engine in a housing of a portable handheld work apparatus.

FIG. 1 shows an internal combustion engine 1 in a housing 2 of a portable handheld work apparatus. The work apparatus can be a lawnmower, a motor-driven chain saw, a cutoff machine, a blower apparatus, a brushcutter or the like.

The internal combustion engine 1 comprises a cylinder 4 which is configured as one piece with the cylinder head 3 in the embodiment shown. The cylinder bore 5 is open toward the crankcase 6 and a reciprocating piston 7 is displaceably arranged in the cylinder bore 5. The piston 7, the cylinder 4 and the cylinder head 3 all conjointly delimit a combustion chamber 8 to which a spark plug 9 is assigned.

The piston 7 drives a crankshaft 11 via a connecting rod 10. The crankshaft 11 drives a work tool and is rotatably supported in the crankcase 6.

The crankcase 6 is connected to a mixture inlet 12 (FIG. 2) which is formed in the cylinder wall 13 and controlled by the piston 7. As can be seen especially from FIG. 2, the combustion chamber 8 is connected to the crankcase 6 via several transfer channels (14, 15) which are open at their ends 16 facing toward the crankcase 6. The combustion chamber end 17 opens into the cylinder wall 13 and all combustion chamber ends 17 are controlled by the piston 7. The transfer channels (14, 15) communicate with respective bypass channels (18, 19) between the combustion chamber end 17 and the crankcase end 16 of these transfer channels (14, 15). The bypass channels (18, 19) supply essentially fuel-free gas, especially air. As shown in FIG. 1 by the partially sectioned illustration of the transfer channels (14, 15) and as seen from FIGS. 2 and 3, the bypass channels (18, 19) open into the transfer channels (14, 15), respectively, via a membrane valve 20 close to the combustion chamber end 17.

Each of the transfer channels (14, 15) is configured as a channel in the cylinder wall 13 closed over its axial length. The membrane valve 20 is pushed axially into the transfer channels (14, 15) via the open ends 16 facing toward the crankcase. The membrane 21 is fixed in a suitable manner on the cylinder 4 or on the cylinder wall 13 in the region of the open end 16 facing toward the crankcase. The membrane projects from the attachment end 22 up to in front of the opening 23 of the bypass channel 18 into the transfer channel 14 and covers this channel completely in the closed state.

In the embodiment shown, the membrane 21 is supported by an essentially stiff membrane carrier 24. The membrane 21 is made of a flexible material and is held at least in the region of the attachment end 22 on the membrane carrier 24. The membrane carrier 24 and the membrane 21 lie in a recess 25 in order to influence the flow in the transfer channels (14, 15) as little as possible and to not disadvantageously narrow the channel cross section. The recess 25 is configured in the outer channel wall of the transfer channel 14. The membrane carrier projects (as does the membrane 21 itself) up to in front of the opening 23 of the bypass channel 18. The membrane carrier has a through opening at the elevation of the opening 23. In the embodiment shown, an opening 26 is provided in the free end of the membrane carrier. This opening is configured approximately the same as the cross-sectional area of the opening 23 and is preferably greater than this opening 23. In the open state, the membrane 21 lies on the membrane carrier 24 and, for this reason, the free end of the membrane is bent out of the recess 25 and projects into the transfer channel 14. In the open state, essentially fuel-free gas flows into the transfer channels in accordance with the arrows shown, until the pressure increases in the crankcase because of the downwardly traveling piston. The pressure is also present in the transfer channels (14, 15) and effects a closure of the membrane valve 20 which transfers reliably into the closed state because of the provided opening 26. The opening 26 furthermore ensures that gas, which flows from the crankcase through the transfer channel into the combustion chamber is not hindered by the membrane carrier projecting into the transfer channel.

The membrane carrier 24 has two projections (27, 28) in the region of the attachment end 22. These projections (27, 28) project into corresponding recesses (30, 31) in the channel wall of the transfer channel.

The first projection 27 is configured in the manner of a cylinder bushing which lies with an approximately precise fit in a through bore 31 for an attachment screw 29. The attachment screw 29 engages with a winding section into the cylinder bushing of the projection 27. The head of the attachment screw 29 is supported on an outer step 32 of the cylinder 4. This has the consequence that, when rotating the attachment screw 29 in the projection 27, the projection seats tightly in the through bore 31 as an assembly aid whereby the membrane carrier 24 is fixed in the region of the open end 16 facing toward the crankcase. The membrane carrier 24 is reliably held in the recess 25 by the external attachment screw 29.

The projection 28 is used to ensure that there is no rotation. This projection 28 lies in a recess 30 of the cylinder wall 13 which is open toward the crankcase 6. The projection 28 constitutes a device which prevents rotation and is formed by a lug which is provided on the end of the membrane carrier 24 facing toward the crankcase.

Figure 3:
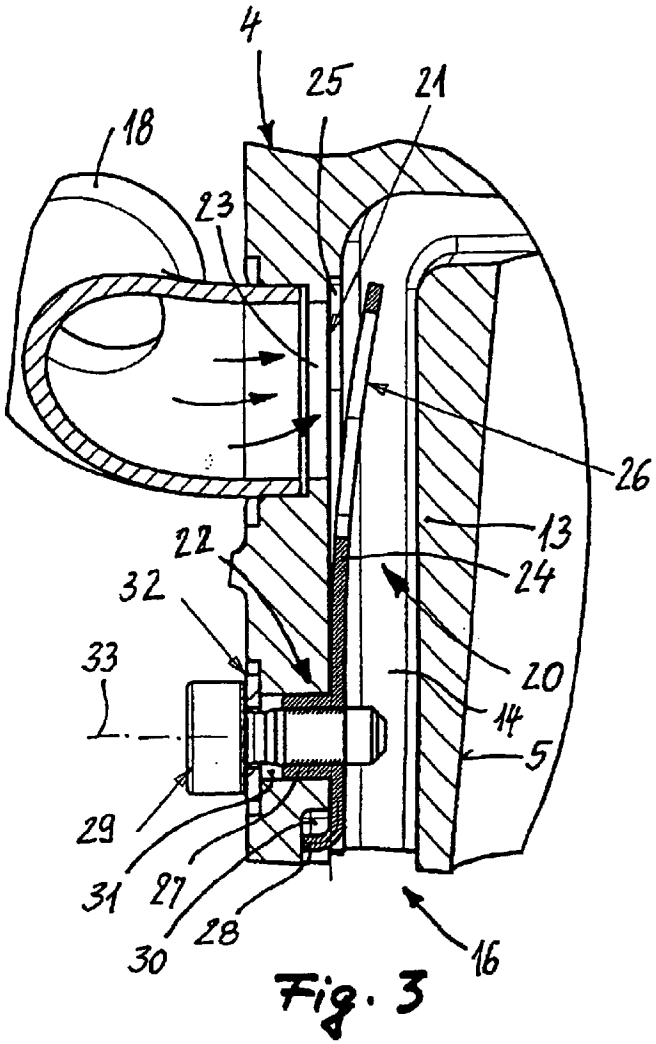
FIG. 3 is an enlarged view of the detail III in FIG. 2.

As shown in FIG. 3, the elevation of the projection 27, which is measured in the direction of the longitudinal axis 33 of the screw, is greater than the elevation of the bent-over lug 28 which is measured in the same direction. By guiding in the membrane carrier 24 with the membrane 21 held thereon into the transfer channel 14, the cylinder bushing is first pushed into the through bore 31. The membrane carrier 24 can also be rotated about the longitudinal axis 33 of the screw because of the overhang of the projection 27. When the projection 27 engages in the through bore 31, the entire membrane carrier is pushed into the recess and the projection 28 of the rotation lock is then guided into the recess 30. The rotation lock 28 determines the position of the membrane carrier 24 about the screw longitudinal axis 33 so that a precise positioning of the membrane carrier in front of the opening 23 of the bypass channel 18 is ensured. The attachment screw 29 can easily be screwed into the cylinder projection 27 from the outside so that a precise position of the membrane valve 20 is ensured in the transfer channel during manufacture even by an inexperienced assembler. This is especially important when the membrane valve 20 is built in without visual control.

Figure 2:
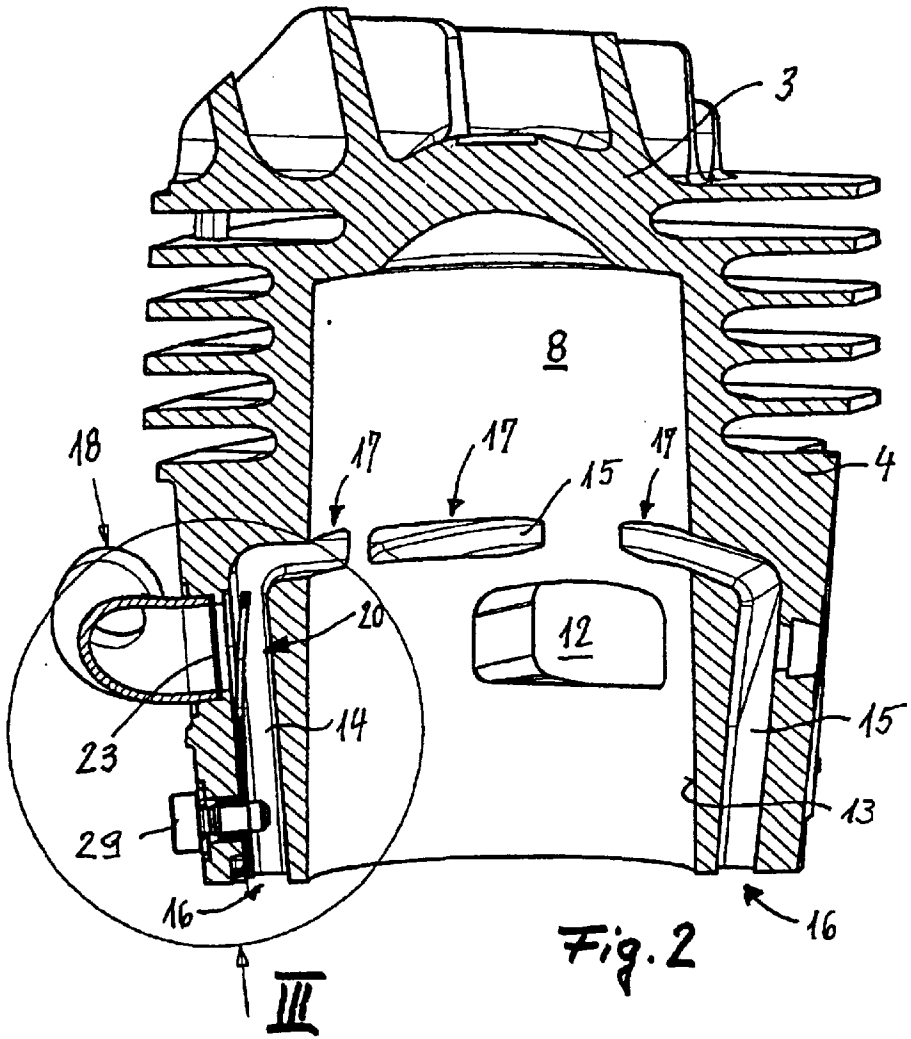
FIG. 2 is a section view through the cylinder of the engine of FIG. 1.

In the embodiments of FIGS. 1 to 3, separate bypass channels (18, 19) are led to the membrane valves 20 in the transfer channels (14, 15), respectively. As shown in FIG. 3, these bypass channels (18, 19) are inserted as insert channels into the outer cylinder wall. Essentially fuel-free gas, that is, air, is distributed via a distributor 34 to corresponding ones of the bypass channels (18, 19) which are assigned to respective transfer channels (14, 15) on respective sides of the cylinder 4. The distributor 34 can be connected to an air throttle path 35 or even to a carburetor. The carburetor 37 is connected via a linkage 36 to the control of the carburetor which prepares the air/fuel mixture. The air throttle path 35 and the carburetor 37 are connected in common to the base 38 of an air filter 39.

When the piston 7 travels downwardly, the mixture, which is inducted into the crankcase 6 via the mixture inlet 12, is compressed and this is associated with a pressure increase. As soon as the piston opens the ends 17 of the transfer channels (14, 15) facing toward the combustion chamber, the mixture flows via the transfer channels into the combustion chamber 8. After passing through bottom dead center, the piston 7 travels again in the direction toward the cylinder head 3, which leads to an underpressure in the crankcase 6. Since the ends 17 of the transfer channels facing toward the combustion chamber are again closed in the meantime, a fresh mixture is induced via the mixture inlet 12 because of the underpressure and simultaneously essentially fuel-free gas or air is drawn in via the bypass channels (18, 19). The membrane valves 20 open when there is an underpressure in the crankcase so that air can enter directly into the transfer channel via the opening 23. After the ignition in the region of top dead center, the piston again travels downwardly and the hot combustion gases are directed away via the outlet 4' before the opening of the transfer channels.

With the attachment of the membrane valve in accordance with the invention because of the open end of the transfer channel facing toward the crankcase, the possibility is provided to manufacture the cylinder with transfer channels closed over their entire length. In the embodiment of FIGS. 4 to 8, the openings 23 of the bypass channels into the transfer channel are configured as one piece with the cylinder head. After the opening, respective connecting stubs 40 are provided which are configured as one piece with the cylinder whereby the connection of the air-conducting bypass channels is simplified.

Figure 5:
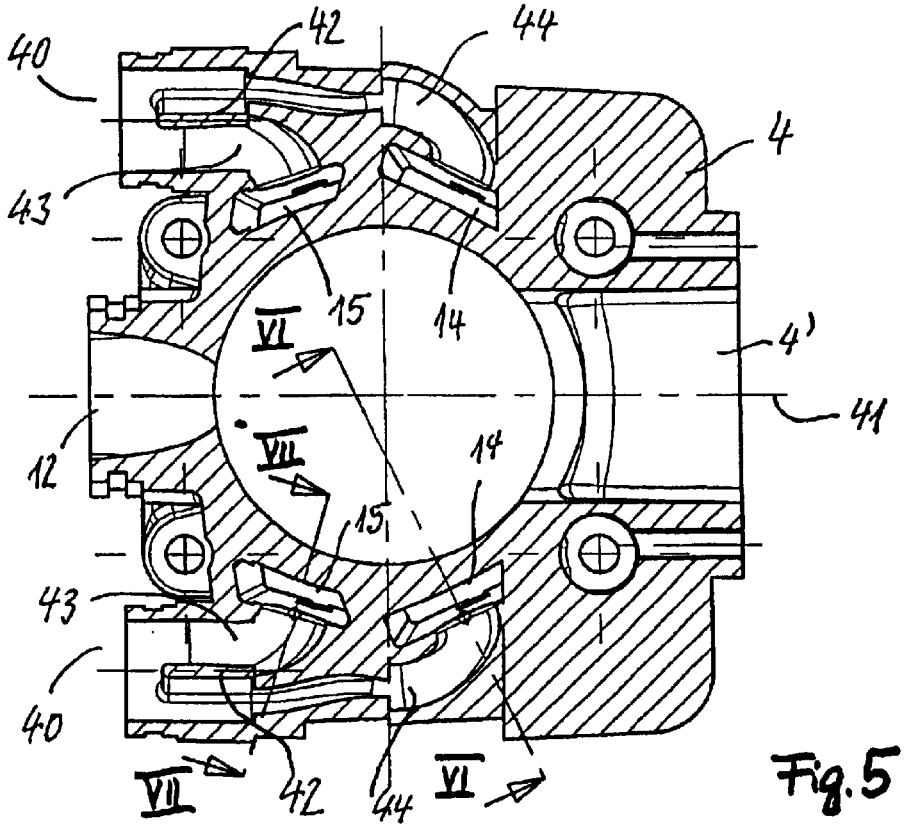
FIG. 5 is a section view through the cylinder of FIG. 4.
Figure 6:
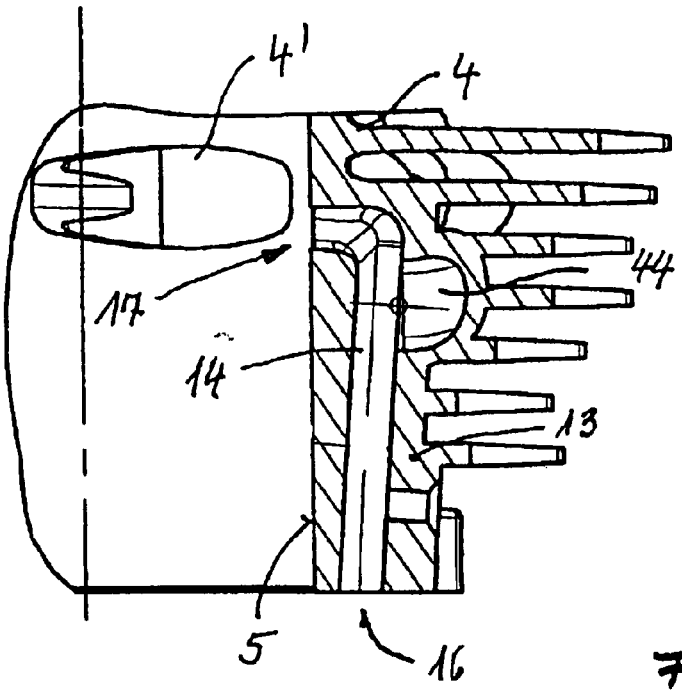
FIG. 6 is a section view taken along line VI—VI of FIG. 5.
Figure 7:
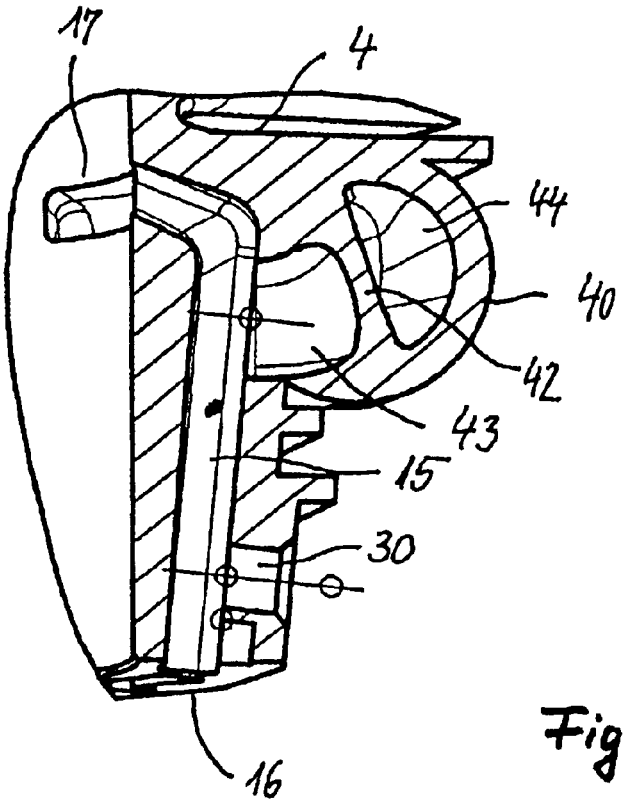
FIG. 7 is a section view along line VII—VII of FIG. 5.

As shown in the section view of FIG. 5, two transfer channels (14, 15) are formed on each side of a symmetry plane 41 partitioning the mixture inlet 12 and an exhaust-gas outlet 4'. The connecting stubs of both transfer channels of one side are combined and open into a common connecting stub 40. The connecting stub 40 has an inner wall 42 which runs in the channel longitudinal direction and this inner wall partitions to form two supplying flow paths (43, 44) in the connecting stub 40. The inner configuration of the connecting stub 40 is shown in FIGS. 6 and 7.

Figure 8:
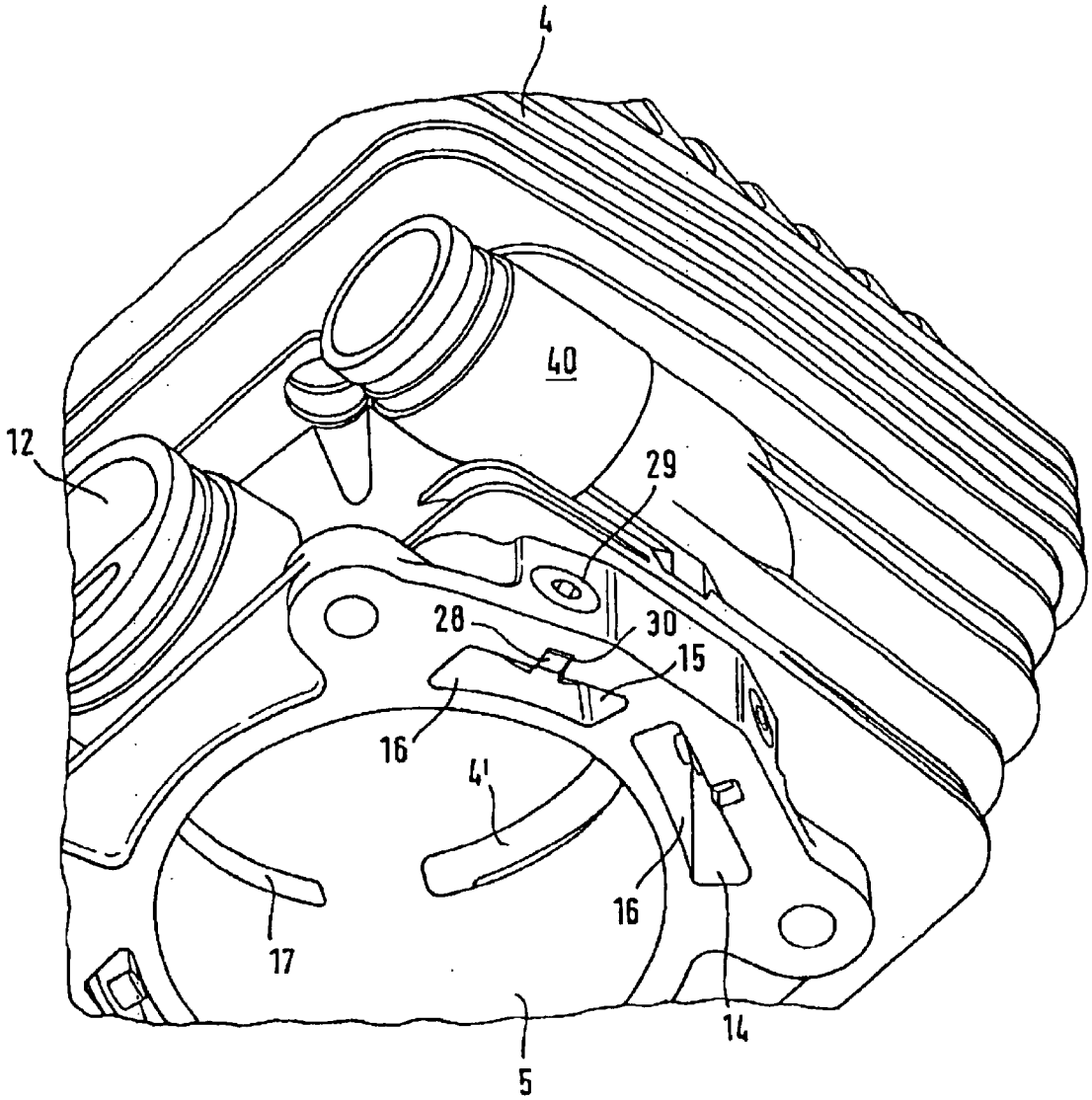
FIG. 8 is a perspective view of the cylinder head of the cylinder of FIG. 4 as seen from below.

The assembly of the membrane valves 20 takes place in the embodiment of FIGS. 4 to 8 in the same manner as described for the embodiment of FIGS. 1 to 3. As shown in FIG. 8, each membrane valve 20 is assembled axially through the open end 16 facing toward the crankcase. In FIG. 8, the slot-like recess 30, which is open to the crankcase, is shown with the lug 28 lying therein and forming a rotation lock.

Figure 4:
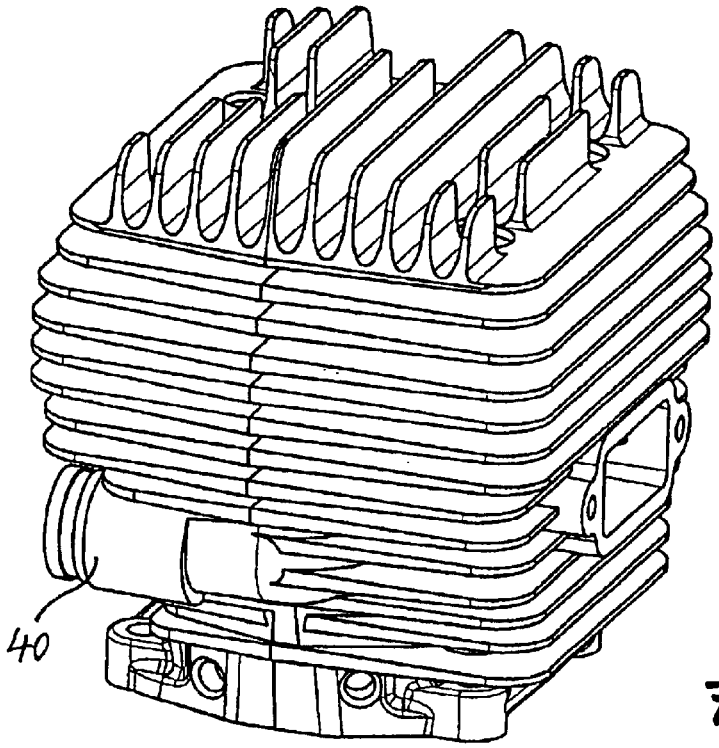
FIG. 4 is a further embodiment of a cylinder for an internal combustion engine according to FIG. 1.
Figure 9:
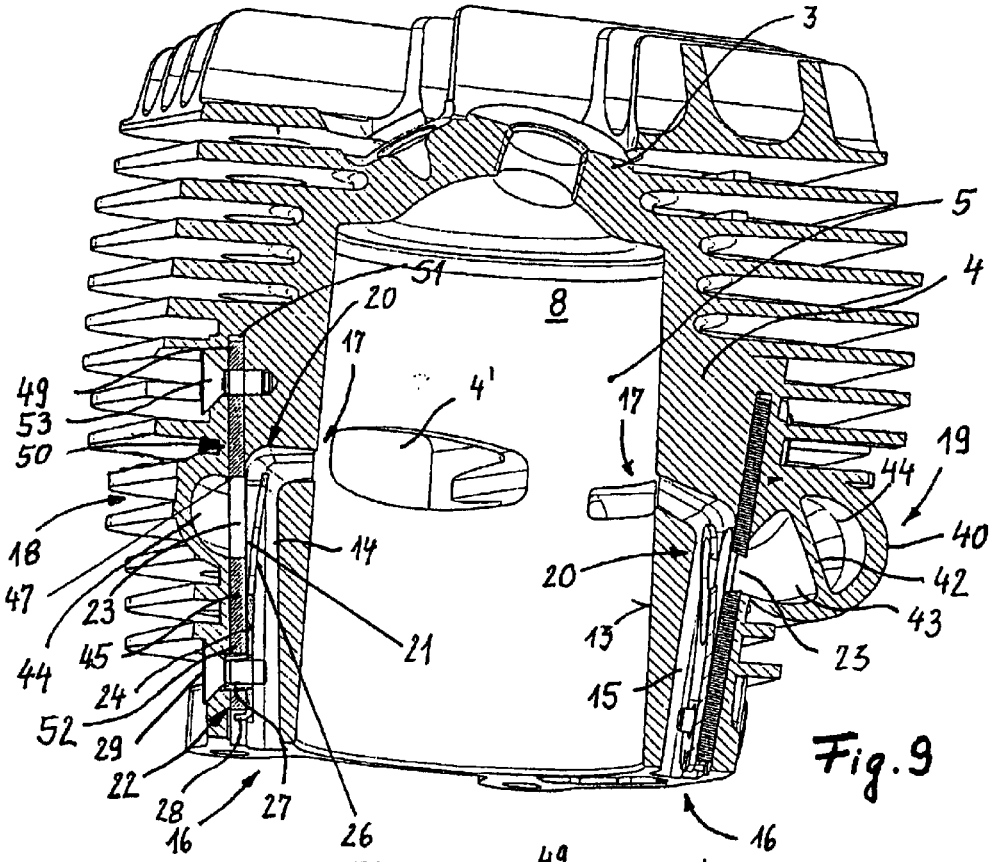
FIG. 9 is a section view through a further embodiment of a cylinder for an internal combustion engine according to FIG. 1.
Figure 10:
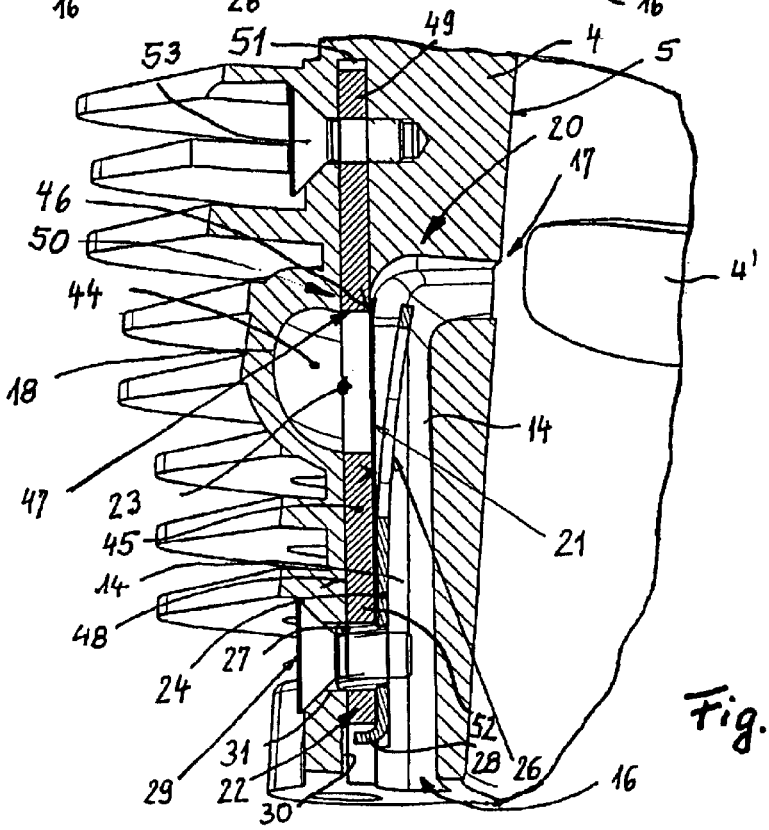
FIG. 10 is an enlarged view of a transfer channel having a membrane carrier mounted therein and an insert plate.

The cylinder of the embodiments of FIGS. 9 and 10 corresponds in its basic configuration to that of FIGS. 2 and 4 and, for this reason, the same reference numerals are used for the same parts.

An insert part 45 is provided in order to form a simply machined sealing surface as a sealing seat 46 for the membrane 21. The insert part 45 is advantageously configured as an insert plate 50. The insert part 45 is configured longer than the transfer channel 14 running in the elevation direction of the cylinder 4. The insert part 45 lies in the correspondingly deep configured recess 30 which is configured in the outer channel inner wall 48. An assembly slot 51 extends from the recess 30 in the elevation direction of the cylinder 4 and is open exclusively to the interior of the transfer channel 14 and extends in the plane of the recess 30.

The insert part 45 is configured separately from the cylinder 4 and is machined in a simple manner outside of the cylinder so that a configuration of the seal seat 46 can be undertaken which satisfies the requirements of the membrane valve 20. The plate-shaped insert part 45 includes a flow opening 47 at the elevation of the opening 23. The flow opening 47 lies approximately coincident with the opening 23 and establishes a connection between the bypass channel 18, which supplies the air, and the transfer channel 14. The flow opening 47 is opened and closed by the membrane 21. The membrane 21 is supported by the membrane carrier 24 in the open position of the membrane.

Preferably, the plate-shaped insert part 45 is assembled outside of the cylinder with the seal seat 46 together with the membrane carrier 24 and the membrane 21 as a preassembled component. For this purpose, the plate-shaped insert part 45 has a bore at its one end 52 into which the projection 27 of the membrane carrier 24 engages. The membrane 21 is held in a clamp-like manner between the attachment end of the membrane carrier 24 and the end 52 of the insert part 45.

When inserting the plate-shaped insert part 45, the end 49, which lies forwardly in the insert direction, is guided into the assembly slot 51. The assembly slot 51 is so configured that the end 49 of the plate-shaped insert part 45 is accommodated with slight play. After the projection 27 is guided into the through bore 31 of the cylinder 4, attachment means are applied radially from the outside and are formed by attachment screws 29 and 53. The end 49 of the plate-shaped insert part 45, which lies in the assembly slot 51, is penetrated by the attachment means 53. The attachment screw advantageously engages with a thread in the material of the cylinder head 3.

In the assembled condition, the plate-shaped insert part 45 is held approximately seal tight against the inner wall 48 of the transfer channel 14. The seal seat 46 lies on the side facing toward the membrane 21. Accordingly, the membrane valve 20 comprising the seal seat 46 of the plate-shaped insert part 45, the membrane 21 and the membrane carrier 24 can be assembled outside of the cylinder and can there be checked and then be pushed into the transfer channel 14 through the end 16 of the transfer channel open to the crankcase and can be fixedly assembled on the inner wall 48 of the transfer channel 14.

Figure 11:
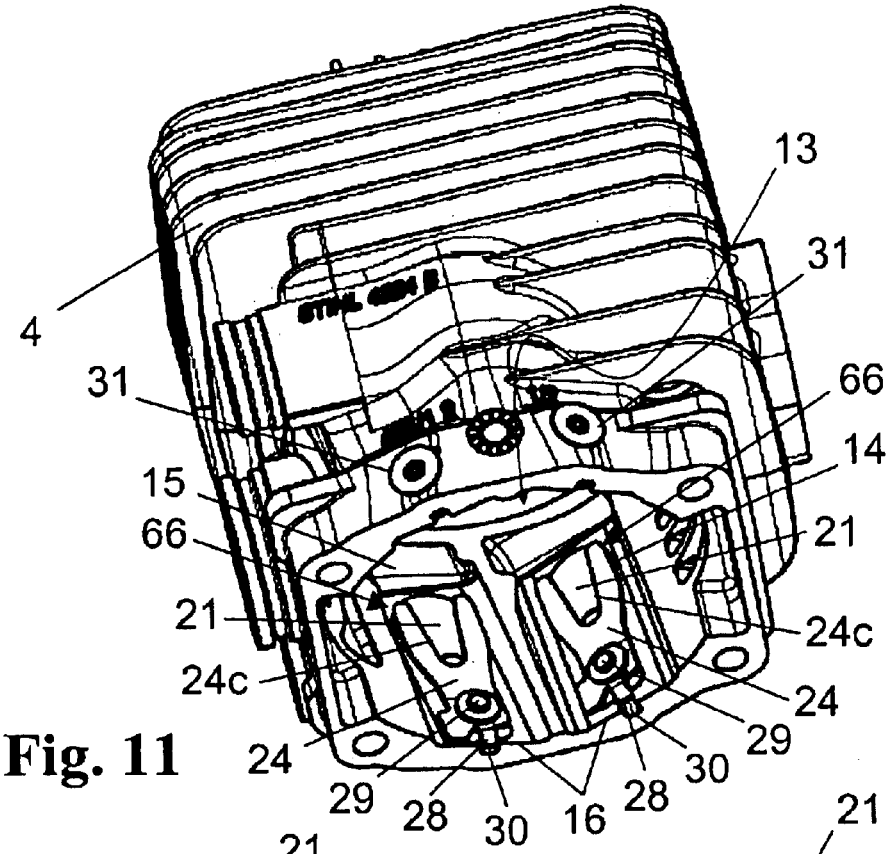
FIG. 11 is a perspective view of a cylinder from below with portions cut away to show the transfer channel.
Figure 12:
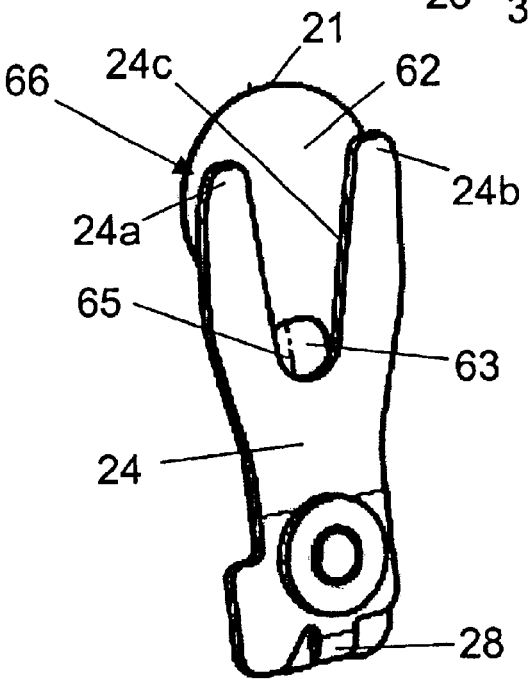
FIG. 12 is a view of a membrane carrier and membrane in accordance with another embodiment of the invention; and, FIG. 13 is a perspective view of the membrane and membrane carrier shown in FIG. 12.
Figure 13:
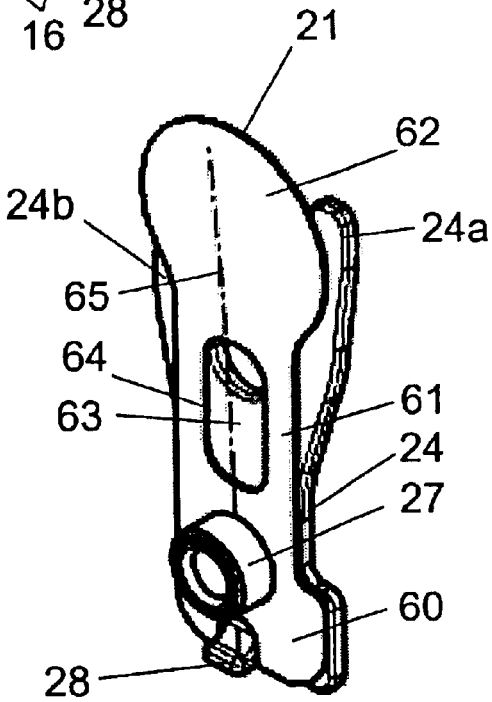

In the embodiment of FIGS. 11 to 13, the configuration of the membrane carrier and the membrane is modified. The membrane 21 includes an attachment section 60 and a closure section 62. These two sections are connected to each other via a connecting section 61.

As shown in FIG. 11, the attachment section 60 is held tightly clamped between the membrane carrier 24 and the foot region of the cylinder 4 within the transfer channel (14, 15). The stiffly configured membrane carrier 24 lies, as shown in FIGS. 9 and 10, at a spacing from the opening 23 of the bypass channel. In its open position, the membrane 21 lies against the membrane carrier as shown in FIGS. 12 and 13. The membrane carrier 24 is bifurcated by a longitudinal slot 24*c* which runs in the longitudinal direction 65 at the end of the carrier facing away from the attachment end. The membrane 21 projects beyond the free ends (24*a*, 24*b*) of the bifurcated portion 66.

An opening 63 is formed in the connecting section 61 of the membrane 21 and this opening is preferably configured as a slot 64 aligned in the longitudinal direction 65 of the connecting section 61. In the open position of the membrane 21 shown in FIGS. 12 and 13, the membrane lies against the membrane carrier 24 and the opening 63 (that is, the longitudinal slot 64) overlaps with the longitudinal slot 24*c* in the membrane carrier 24. In this way, in the open position of the membrane 21, a passthrough is formed which defines a direct connection from the rearward side of the membrane carrier 24 to the forward side of the membrane 21. In this way, and for the open position of the membrane 21, the fuel-free gas, which enters via the opening 23, can not only flow into the transfer channel (14, 15) by flowing around the connecting section 61 and the membrane carrier 24 but also along a direct path into the transfer channel (14, 15) via a direct path through the opening 63 in the membrane 21 and through the longitudinal slot 24*c* in the bifurcated end of the membrane carrier 24.

As in the other embodiments, the membrane carrier 24 is mounted with an attachment means 29 which engages through from the outside and is preferably an attachment screw mounted in the foot region of the cylinder 4. A projection 28 of the membrane carrier 24 engages in a recess 30 of the cylinder wall 13 and acts to prevent rotation and/or acts as assembly aid. It is practical when this projection 28 is configured as an angled lug at the end of the membrane carrier 24.

It is understood that the foregoing description is that of the preferred embodiments of the invention and that various changes and modifications may be made thereto without departing from the spirit and scope of the invention as defined in the appended claims.

What is claimed is:

1. A two-stroke engine including a two-stroke engine in a portable handheld work apparatus, the two-stroke engine comprising:

a crankcase;

a cylinder connected to said crankcase;

said cylinder having a cylinder wall defining a cylinder bore open to said crankcase;

a piston displaceably mounted in said cylinder bore and said piston and said cylinder conjointly defining a combustion chamber;

a crankshaft rotatably mounted in said crankcase;

said piston being operatively connected to said crankshaft for driving said crankshaft;

a mixture inlet in said crankcase;

a transfer channel for flow connecting said crankcase to said combustion chamber and said transfer channel having a first end open to said crankcase and a second end communicating with said combustion chamber;

a bypass channel for conducting an essentially fuel-free gas;

said bypass channel having an opening into said transfer channel at a location between said first and second ends thereof;

said transfer channel being configured as a closed channel over the length thereof in said cylinder wall;

a membrane valve assembly including a membrane axially inserted into said transfer channel through said first end thereof;

said membrane having an attachment section and projecting in said transfer channel up to in front of said opening;

said membrane being movable between a closed position wherein said opening is closed and an open position wherein said fuel-free gas can flow through said opening and into said transfer channel;

said membrane valve assembly further including a membrane carrier for supporting said membrane in said open position thereof; and, said membrane being fixedly clamped at said attachment position thereof between said membrane carrier and said cylinder at the foot region thereof.

2. The two-stroke engine of claim 1, wherein said membrane carrier is configured as a stiff membrane carrier.

3. The two-stroke engine of claim 1, wherein said membrane includes a closing section and a connecting section interconnecting said closing section and said attachment section.

4. The two-stroke engine of claim 1, wherein said membrane carrier is bifurcated in the region of said opening so as to have fork-like prongs conjointly defining a longitudinal slot therebetween.

5. The two-stroke engine of claim 4, wherein said membrane extends beyond the free ends of said prongs.

6. The two-stroke engine of claim 4, wherein said membrane has an opening formed therein in said connecting section thereof which overlaps with said longitudinal slot in said membrane carrier.

7. The two-stroke engine of claim 6, wherein said opening in said membrane is an elongated slot aligned in the longitudinal direction of said connecting section.

8. The two-stroke engine of claim 1, said membrane valve assembly further comprising attachment means for fixing said membrane carrier; and, said attachment means engaging through said cylinder wall from the outside.

9. The two-stroke engine of claim 8, said attachment means being an attachment screw threadably engaging said membrane carrier.

10. The two-stroke engine of claim 1, wherein said cylinder has a recess formed therein; and, said membrane carrier has an end portion facing toward said crankcase and has a projection formed thereon at said end portion for engaging said recess.

11. The two-stroke engine of claim 10, wherein said projection is configured to prevent said membrane carrier from rotating in said transfer channel.

12. The two-stroke engine of claim 10, wherein said projection is configured to be of assistance during assembly of said membrane valve assembly in said transfer channel.

13. The two-stroke engine of claim 10, wherein said projection is configured as an angled lug of said membrane carrier.

* * * * *